US005806843A

United States Patent [19]

Hansen et al.

[11] Patent Number: 5,806,843

[45] Date of Patent: Sep. 15, 1998

[54] MULTI TRAY AND BUFFER TRAY MISFEED DETECTOR WITH VOLTAGE RESPONSE ADJUSTMENT

[75] Inventors: Paul Hansen, Westminster; Sheldon F. Raizes, Palos Verdes, both of Calif.

[73] Assignee: Xerox Corporation, Stamford, Conn.

[21] Appl. No.: 782,324

[22] Filed: Jan. 13, 1997

[51] Int. Cl.[6] ..... B65H 5/22

[52] U.S. Cl. ..... 271/3.03; 271/3.13; 271/9.01; 271/9.13; 271/263; 271/265.04

[58] Field of Search ..... 271/3.03, 3.13, 271/9.01, 9.13, 263, 259, 265.04, 265.02

[56] References Cited

U.S. PATENT DOCUMENTS

| | | | |
|---|---|---|---|
| 5,105,078 | 4/1992 | Nochise et al. | 271/263 |
| 5,503,382 | 4/1996 | Hansen et al. | 271/3.03 |
| 5,584,472 | 12/1996 | Hidding et al. | 271/3.03 |
| 5,586,755 | 12/1996 | Hanset | 271/3.03 |

*Primary Examiner*—H. Grant Skaggs

[57] ABSTRACT

The sheets in each tray of a multi tray sheet feeder are of the same thickness, but the sheets in one tray may be of a different thickness than the sheets in another tray. The sheets are fed from each sheet feeder tray to an intermediate stacker and then to a printer. A first sensor is provided just prior to entry of a sheet into the intermediate stacker and a second sensor is provided to sense a sheet as it is fed from the intermediate stacker. If the paper weight of sheets of paper on a tray fall within a first range of paper weight values, each sensor is designed to have a first given voltage response condition when sensing those sheets and if the paper weight of the sheets falls within a second range of paper weight values each sensor is designed to have a second given voltage response condition sensing the latter sheets. A current value supplied to the emitter of a sensor can be controlled to provide the desired voltage response or a resistance in a phototransistor collector circuit can be varied to provide the desired voltage response condition. If the first range of paper weight values is lighter than the second range of paper weight values, each sensor, when in the first given voltage response condition, will have a voltage response, when sensing a sheet of a given paper weight, which is higher than the voltage response when the same sensor senses a sheet of the same paper weight, when each sensor is in the second given voltage response condition. The first sensor is placed in a proper voltage response condition to sense the thickness of a sheet that has been fed from a particular tray and that thickness value is compared with a single sheet thickness value, sensed by the first sensor when in the same voltage response condition, that has been placed in memory for the sheets on that particular tray to detect a multi sheet feed from the tray. The sheet then enters the intermediate stacker. When the same sheet is fed from the intermediate stacker, it is sensed by the second sensor. The second sensor is placed in the same voltage response condition as the first sensor when it sensed the same sheet and the thickness value sensed by the second sensor is compared with the thickness value sensed of the same sheet by the first sensor to detect a multi sheet feed from the intermediate stacker.

25 Claims, 5 Drawing Sheets

MULTI TRAY AND BUFFER TRAY MISFEED DETECTOR WITH VOLTAGE RESPONSE ADJUSTMENT

This application is related to copending U.S. application Ser. No. 08/782,323 entitled Single Tray and Multi Tray Misfeed Detector with Voltage Response Adjustment, filed concurrently herewith, and U.S. application Ser. No. 08/782,325, entitled Misfeed Detector with Voltage Response Adjustment, filed concurrently herewith. Each of these applications is assigned to the assignee of this application.

BACKGROUND

This invention relates to a system for detecting a multi-sheet feed from paper trays.

It is common to employ with laser printers, a multi-tray sheet feeder with an intermediate stacker. The sheets in each tray are of the same thickness, but the sheets in one tray may be of a different thickness than the sheets in another tray. The sheets are fed from each sheet feeder tray to the intermediate stacker and then to the printer. The sheets in the intermediate stacker will be of varying thicknesses if the sheets in one tray are of a different thickness than the sheets in another tray. It is important that only one sheet at a time be fed from each tray and from the intermediate stacker and if more than one sheet is fed from the tray and/or stacker, that it be detected immediately and the system can be either shut down to correct the situation or the offending sheets be sent to a purge tray at the printer without shutting down the system. Each sheet fed from a tray is sensed by a sensor just prior to the sheet entering into the intermediate stacker and the thickness value sensed is compared to a thickness value for a single sheet in memory for that tray. Each sheet fed from the stacker is sensed by a second sensor and the thickness value sensed is compared to the thickness value for the same sheet that was sensed just prior to the sheet entering into the intermediate stacker. If the thickness values match, then only one sheet has been fed from a tray or the intermediate stacker. If the thickness value is more that the thickness value in memory, then that indicates that more than one sheet has just left the tray.

The sensor comprises an emitter and a phototransistor between which the sheets of paper pass. The emitter emits light rays through the sheets of paper that are sensed by the phototransistor. It is common to supply a given fixed current to the emitter when sensing sheets passing through the sensor even though the sheets sensed may vary significantly in paper weight. This causes a problem at certain paper weights since the difference between voltage response at the phototransistor for a single sheet and the voltage response for two sheets, each of the same paper weight as the single sheet, fed through the sensor can be small enough that the voltage responses can overlap due to imperfections in the paper, images that are on preprinted paper, misalignment between the emitter and phototransistor, and response variations between different phototransistors. This could cause false detections of double fed sheets.

Therefore, it is an object of this invention to provide a large enough difference between the voltage response at the phototransistor for a single sheet and the voltage response for two sheets, each of the same paper weight as the single sheet, fed through the sensor to avoid any overlap due to imperfections in the paper, images that are on preprinted paper, misalignment between the emitter and phototransistor, and response variations between different phototransistors.

SUMMARY OF INVENTION

The system employing this invention comprises a laser printer, a multi-tray sheet feeder and an intermediate stacker. The sheets in each tray are of the same thickness, but the sheets in one tray may be of a different thickness than the sheets in another tray. The sheets are fed from each sheet feeder tray to the intermediate stacker and then to the printer. A first sensor is provided just prior to entry of a sheet into the intermediate stacker and a second sensor is provided to sense a sheet as it is fed from the intermediate stacker.

If the paper weight of sheets of paper on a tray fall within a first range of paper weight values, each sensor is designed to have a first given voltage response condition and if the paper weight of the sheets falls within a second range of paper weight values each sensor is designed to have a second given voltage response condition. A current value supplied to the emitter of a sensor can be controlled to provide the desired voltage response or a resistance in a phototransistor collector circuit can be varied to provide the desired voltage response condition. If the first range of paper weight values is lighter than the second range of paper weight values, each sensor, when in the first given voltage response condition, will have a voltage response, when sensing a sheet of a given paper weight, which is higher than the voltage response when the same sensor senses a sheet of the same paper weight, when each sensor is in the second given voltage response condition. This way the difference between a voltage response at the phototransistor for a single sheet and a voltage response for two sheets, each of the same paper weight as the single sheet, fed through each sensor is large enough throughout all paper weight ranges to obviate the possibility of voltage response overlap.

A proper current value is supplied to the emitter of the first sensor or proper resistance in the phototransistor collector circuit is provided to the first sensor to place the first sensor in a proper voltage response condition to sense the thickness of a sheet that has been fed from a particular tray and that thickness value is compared with a single sheet thickness value, sensed by the first sensor when in the same voltage response condition, that has been placed in memory for the sheets on that particular tray to detect a multi sheet feed from the tray. The sheet then enters the intermediate stacker. When the same sheet is fed from the intermediate stacker, it is sensed by the second sensor. A proper current value is supplied to the emitter of the second sensor or proper resistance in the phototransistor collector circuit is provided to the second sensor to place the second sensor in the same voltage response condition as the first sensor when it sensed the same sheet and the thickness value sensed by the second sensor is compared with the thickness value sensed of the same sheet by the first sensor to detect a multi sheet feed from the intermediate stacker.

DETAILED DESCRIPTION OF THE INVENTION

Figure 1:
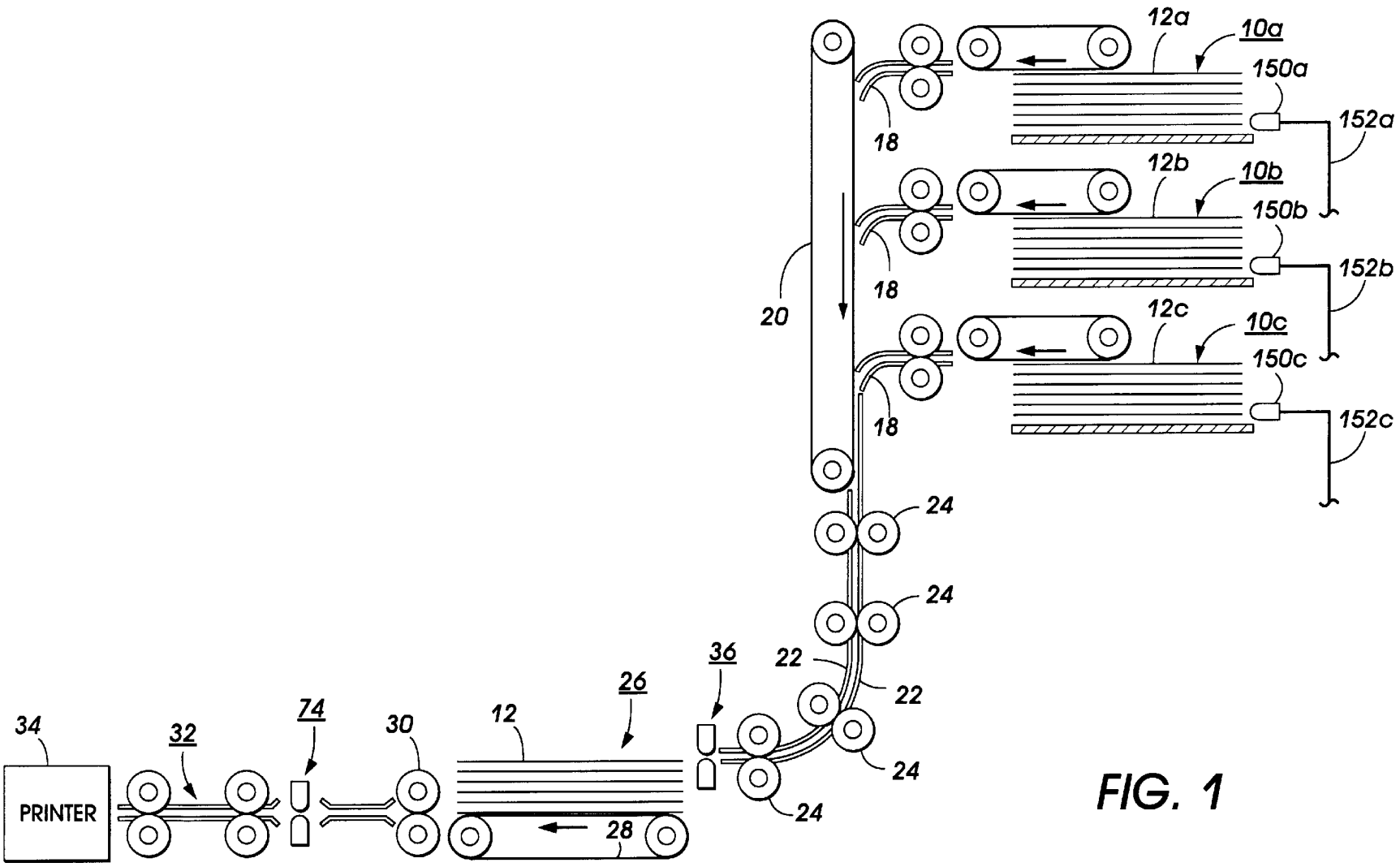
FIG. 1 is a schematic view of a multi-tray printing system which includes an intermediate or buffer sheet tray.

Referring to FIG. 1, there is shown a printing system comprising three feed trays 10*a*, 10*b*, and 10*c*, each having a plurality of sheets 12*a*, 12*b* and 12*c* stacked therein. The sheets in each tray are of the same thickness as the others in the same tray, but are of a different thickness than the sheets in the other trays. A sheet feeding apparatus 18 is provided for each feed tray and a common vacuum sheet transport belt conveyor 20 transports a sheet to guides 22 where a plurality of driven nip rolls 24 move a sheet through the guides to an intermediate stacker 26. Sheets are bottom fed from the stacker 26 by a vacuum transport belt 28 to nip rolls 30 which move the sheets to a printer entry transport 32 from which the sheets enter a laser printer 34 where an image is transferred to each sheet.

Figure 2:
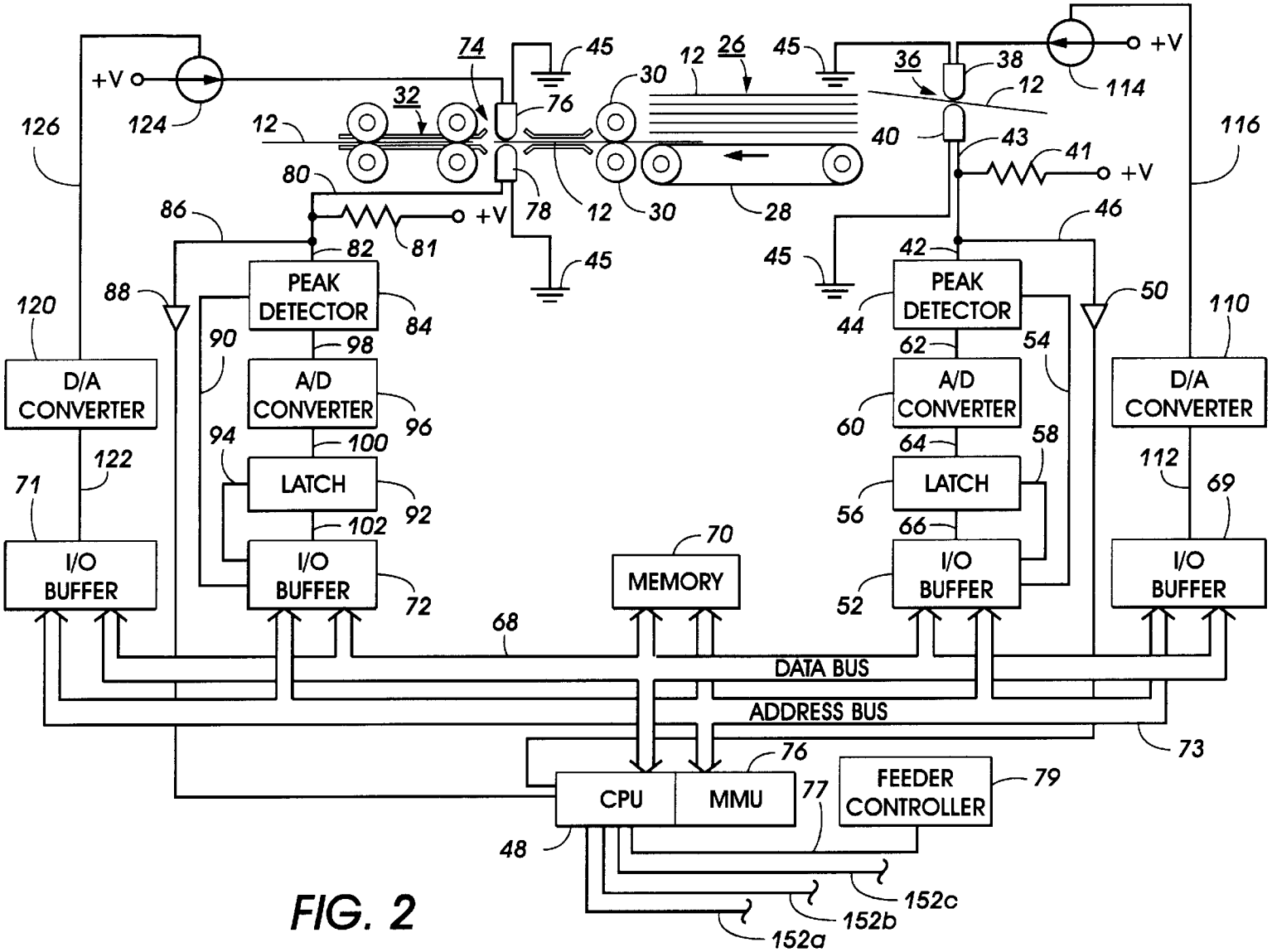
FIG. 2 is a block schematic diagram of a multi-sheet feed detector operating system embodying this invention for the printing system illustrated in FIG. 1.

Referring to FIG. 2, there is shown the intermediate sheet stacker 26 and a sheet thickness sensing arrangement. An inlet sensor 36 is provided at the inlet of the stacker 26 and comprises an infrared emitter 38 and a phototransistor 40. Any type of emitter can be used, but infrared is preferred. The collector 43 of the phototransistor 40 is connected through a control line 42 to a peak detector 44 and through control line 46 to a CPU (central processing unit) 48. A positive transition detector 50 is located in control line 46 between the phototransistor 40 and the CPU 48 and detects sudden voltage changes at the collector 43. The peak detector 44 detects a peak voltage at collector 43 and is connected to an I/O (Input/output) buffer 52 through a control line 54 to allow the CPU to reset the peak detector to zero. A latch 56 is connected to the I/O buffer 52 through a control line 58 to allow the CPU to implement a data latch function. An A/D (analog/digital) converter 60 is connected to the peak detector 44 by line 62 and to the latch 56 by a data line 64. A data line 66 connects the latch 56 to the I/O buffer 52. A data bus 68 links the CPU 48 with the I/O buffer 52, memory 70 and three other I/O buffers 69, 71 and 72. The memory 70 is a two part memory having a RAM and an EPROM. An address bus 73 links a MMU (memory management unit) 76 with the I/O buffers 52, 69, 71 and 72 and the memory 70. The CPU 48 is connected through a control line 77 to a feeder controller 79 for controlling feeding of the sheets from the trays 10*a*, 10*b*, and 10*c* and into and out of the intermediate stacker 26.

At the outlet of the intermediate stacker 26 is an outlet sensor 74 which comprises an infrared emitter 76 and a phototransistor 78 with a collector 80. The collector 80 of the phototransistor 78 is connected through a control line 82 to a peak detector 84 and through control line 86 to the CPU 48. A positive transition detector 88 is located in control line 86 between the phototransistor 78 and the CPU 48 and detects sudden voltage changes at the collector 80. The peak detector 84 detects a peak voltage at collector 80 and is connected to the I/O buffer 72 through a control line 90 to allow the CPU to reset the peak detector to zero. A latch 92 is connected to the I/O buffer 72 through a control line 94 to allow the CPU to implement a data latch function. An A/D converter 96 is connected to the peak detector 84 by line 98 and to the latch 92 by a data line 100. A data line 102 connects the latch 92 to the I/O buffer 72.

The I/O buffer 69 is connected to a digital to analogue to digital (D/A) converter 111 by a data line 112. The D/A converter 111 is connected to a current source 114 for the emitter 38 by a current control line 116. The CPU 48 addresses the I/O buffer 69 by the address bus 73 and inputs a value of current to the buffer 69 by data bus 68. The buffer 69 inputs that value to the D/A converter 111 over the data line 112 and that value is converted by the D/A converter 111 to an analogue signal that is transmitted to the current source 114 by current control line 116 to supply a given current to the emitter 38.

The I/O buffer 71 is connected to a digital to analogue (D/A) converter 120 by a data line 122. The D/A converter 120 is connected to a current source 124 for the emitter 76 by a current control line 126. The CPU 48 addresses the I/O buffer 71 by the address bus 73 and inputs a value of current to the buffer 71 by data bus 68. The buffer 71 inputs that value to the D/A converter 120 over the data line 122 and that value is converted by the D/A converter 120 to an analogue signal that is transmitted to the current source 124 by current control line 126 to supply a given current to the emitter 76.

The amount of current that flows through the phototransistors 40, 78 is a function of the amount of light to which a phototransistor is exposed. If the exposure to light is increased, more current will flow and if the exposure to light is decreased, less current will flow. The emitters 38 and 76 each emits rays towards the base of its respective phototransistor 40 and 78 which strike the phototransistors 40, 78 at maximum intensity when a sheet of paper is not between the emitter and its respective phototransistor. Therefore, there is maximum current flow across a resistor 41 when a sheet of paper is not between emitter 38 and its respective phototransistor 40 and the voltage difference between ground 45 and the collector 43 of the phototransistor 40 is at its lowest value in this condition. It also follows that there is maximum current flow across a resistor 81 when a sheet of paper is not between emitter 76 and its respective phototransistor 78 and the voltage difference between ground 45 and the collector 80 of the phototransistor 78 is at its lowest value in this condition. Furthermore, there is maximum current flow across a resistor 121 when a sheet of paper is not between emitter 118 and its respective phototransistor 120 and the voltage difference between ground 45 and the collector 122 of the phototransistor 120 is at its lowest value in this condition.

When a sheet of paper passes between the emitter 38 and the phototransistor 40, light from the emitter will pass through the sheet of paper with the amount of light passing through being dependent upon the thickness of the paper. More light will pass through a thin sheet than a thick sheet. Since the phototransistor 40 is exposed to less light when a sheet of paper is passing between the emitter 38 and the phototransistor 40, less current flows across resistor 41 and the voltage difference between the collector 43 and ground 45 increases. The voltage difference between ground 45 and the collector 43 will increase in accordance with an increase in the thickness of a sheet since the amount of light to which the phototransistor 40 is exposed decreases as the thickness of a sheet sensed increases. This principle also applies when a sheet of paper passes between the emitter 76 and the phototransistor 78 and therefore the voltage difference between ground 45 and the collector 80 will increase in accordance with an increase in the thickness of a sheet.

There is a problem with measuring the flow of light through the sheets of paper. If the voltage difference between the voltage response of the phototransistors 40, 78 to light passing through one sheet of paper of a given paper weight and the voltage response to light passing through two sheets of paper of the same given paper weight is small, then the voltage responses could overlap due to imperfections in the paper and due to imperfections in the paper, images that are on preprinted paper, misalignment between the emitter and phototransistor, and response variations between different phototransistors. This could cause false detections of double fed sheets.

Figure 3:
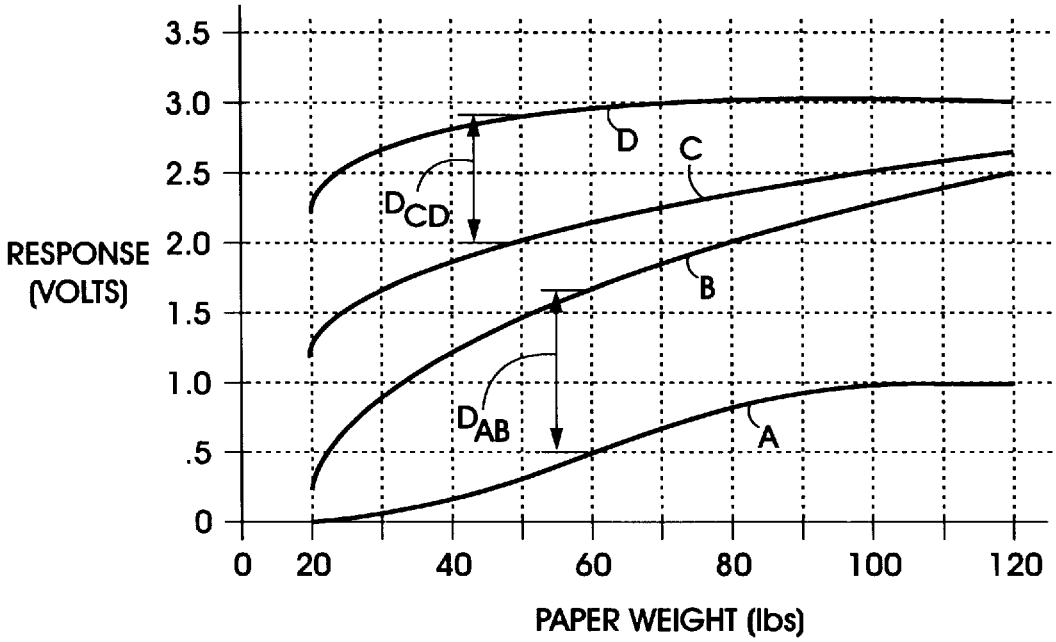
FIG. 3 is a graph of two sets of curves illustrating voltage response at the phototransistor for single sheets and double sheets depending upon the current supplied to the emitter and the paper weight of the single sheet measured and double sheet measured.

Referring to FIG. 3, there is shown a graph of four curves of a paper weight/voltage response relationship utilizing two different current values for the emitters 38, 76 of the sensors 36 and 74, respectively. The following discussion will be directed to the emitter 38 although it should be noted that the same applies to emitter 76. Curve A represents the voltage response (vertical axis) when a single sheet at different weights (horizontal axis) is passed across the sensor 36 and a current of 25 milliamps is supplied to the emitter 38 of sensor 36. Curve B represents the voltage response when two sheets, each of which is of the weight indicated along the horizontal axis for a single sheet, are passed across the sensor 36 and a current of 25 milliamps is supplied to the emitter 38 of sensor 36. Curve C represents the voltage response when a single sheet at different weights is passed across the sensor 36 and a current of 12 milliamps is supplied to the emitter 38 of sensor 36. Curve D represents the voltage response when two sheets, each of which is of the weight indicated along the horizontal axis for a single sheet, are passed across the 36 and a current of 12 milliamps is supplied to the emitter 38 of sensor 36.

From looking at curves A and B, one can see that the difference $D_{AB}$ between the voltage responses for a single sheet with a paper weight of 20 lbs. and two sheets, each of which is a paper weight of 20 lbs., is about 0.3 volt; the difference between the voltage responses for a single sheet with a paper weight of 30 lbs. and two sheets, each of which is a paper weight of 30 lbs., is about 0.75 volt; and the difference between the voltage responses for a single sheet with a paper weight of 40 lbs. and two sheets, each of which is a paper weight of 40 lbs., is about 1 volt. From inspection of the two curves A and B, one can see that the difference $D_{AB}$ between the voltage responses for a single sheet and two sheets continues to expand to 1.5 volts through a single sheet of a paper weight of 120 lbs. and two sheets, each of which is a paper weight of 120 lbs. It should be recalled that these two curves, A and B are generated using 25 milliamps at the emitter 38.

From looking at curves C and D, one can see that the difference $D_{CD}$ between the voltage responses for a single sheet with a paper weight of 20 lbs. and two sheets, each of which is a paper weight of 20 lbs., is about 1 volt; the difference between the voltage responses for a single sheet with a paper weight of 30 lbs. and two sheets, each of which is a paper weight of 30 lbs., is about 1 volt; and the difference between the voltage responses for a single sheet with a paper weight of 40 lbs. and two sheets, each of which is a paper weight of 40 lbs., is about 0.9 volt. From inspection of the two curves C and D, one can see that the difference $D_{CD}$ between the voltage responses for a single sheet and two sheets continues to decrease to about 0.4 volt through a single sheet of a paper weight of 120 lbs. and two sheets, each of which is a paper weight of 120 lbs. It should be recalled that these two curves, C and D are generated using 12 milliamps at the emitter 38.

Single sheet paper weight of 20 lbs. is the most popular paper used and one can see that by obtaining a high voltage response for this weight of paper, it would be the most beneficial when compared to obtaining a low voltage response at this weight since there is an approximate 1 volt difference between a high voltage response (see curves C and D) for a single sheet of a 20 lb. weight and a high voltage response for two sheets, each of which is 20 lb. weight whereas the difference when there is a low voltage response (see curves A and B) is about 0.3 volt.

It can also be appreciated that when sheets of paper of a heavier weight are used, it is more beneficial to obtain a low voltage response, since for instance for a sheet of a paper weight of 60 lb. there is an approximate 1.25 volt difference between the low voltage response (see curves A and B) for a single sheet of a 60 lb. paper weight and a low voltage response for two sheets, each of which is a 60 lb. paper weight, whereas the difference when there is a high voltage response (see curves C and D) is about 0.75 volt. The advantage of a low voltage response for heavier sheets of paper is even greater when a sheet of a paper weight of 100 lb. or heavier weight is used since there is an approximate 1.5 volt difference between a low voltage response for a single sheet of a 100 lb. paper weight and a low voltage response for two sheets, each of which is 100 lb. paper weight, whereas the difference when there is a high voltage response (see curves C and D) is about 0.5 volt.

It follows that it would be most desirable to use a voltage response around 1.25 to 1.65 volts for sheets of a paper weight of less than about 30 lbs. and to use a voltage response of 0.25 volt for sheets of a paper weight that are above 30 lbs. in order to obtain maximum voltage differential between the voltage response to a single sheet of a given paper weight and the voltage response to two sheets of the same given paper weight. However, it is not desirable to use a voltage response for a single sheet until the voltage response level starts approaching about 0.4 volt. Otherwise the voltage response is too close to zero level to obtain significant confidence in the response level. Therefore, one might desire to use a voltage response in a range of about 0.4 volt to 1 volt at the sensors for sheets with a paper weight starting at between the range of 50 to 60 lbs. and above and use a voltage response in the range of about 1.25 to 2 volts at the sensors for sheets with a paper weight below the range of 50 to 60 lbs.

Therefore, it is preferable to have the difference between a voltage response at the phototransistor for a single sheet and a voltage response for two sheets, each of the same paper weight as the single sheet, fed through the sensor to be large enough throughout all paper weight ranges to obviate the possibility of voltage response overlap. This can be accomplished by providing a sensor which is capable of being in a first given voltage response condition for sensing sheets of a first given paper weight range and a second given voltage response condition for sensing sheets of a second paper weight range which is heavier than the first range. The voltage response conditions will be such that when the sensor is in the first given voltage response condition, the sensor will have a voltage response, when sensing a sheet of a given paper weight, which is higher than the voltage response when the sensor is in the second given voltage response condition and senses a sheet of the same paper weight.

Assume that a desirable characteristic of a sensor would be to have a sensor obtain a voltage response when sensing single sheets with a paper weight range up to and including 50 lbs. which would be more than the voltage response when sensing single sheets with a paper weight range above 50 lbs. One would then calibrate the sensor by picking out a voltage response that would be desired at a particular paper weight in each range and then adjust the current to the emitter to obtain that voltage response. For instance, a sheet of a paper weight of 20 lbs. would be passed through a sensor to obtain a desired voltage response of 1.25 volts. According to curve C in FIG. 3, the current that would be supplied to the emitter is 12 milliamps to obtain the voltage response of 1.25 volts. Depending upon the alignment between the emitter and the phototransistor and the response characteristics of the phototransistor, the 12 milliamps may or may not supply the desired 1.25 volts and the current may have to be adjusted accordingly to obtain such. The calibration can be performed manually.

After the sensor is calibrated for the sheet of 20 lb. paper weight, a sheet of a paper weight of 60 lbs. is passed through a sensor to obtain a desired voltage response of 0.5 volt. According to curve A in FIG. 3, the current that would be supplied to the emitter is 25 milliamps to obtain the voltage response of 0.5 volt. Depending upon the alignment between the emitter and the phototransistor and the response characteristics of the phototransistor, the 25 milliamps may or may not supply the desired 0.5 volt and the current may have to be adjusted accordingly to obtain such.

Assuming that 12 milliamps and 25 milliamps satisfy the voltage response of the sensor to sense sheets of a paper weight of 20 lbs. and 60 lbs., respectively, then 12 milliamps would be supplied to the emitter when sheets with a paper weight range up to and including 50 lbs. are sensed and 25 milliamps would be supplied to the emitter when sheets with a paper weight range above 50 lbs. are sensed. This sets the sensor to be in a first voltage response condition (when 12 milliamps are supplied to the emitter) having a voltage response, when sensing a sheet of a given paper weight, which is higher than a voltage response when the sensor senses a sheet of the same paper weight, when the sensor is in a second voltage response condition (when 25 milliamps is supplied to the emitter).

If a different voltage response was desired for a sheet of a paper weight of 20 lbs., such as 1 volt, then one can see from curves A and C in FIG. 3 that the current to be supplied to the emitter sensor to obtain such voltage response would fall between 12 and 25 milliamps. Similarly, if the voltage response was desired for a sheet of a paper weight of 60 lbs. was 0.75 volt, the current to be supplied to the emitter of the sensor to obtain such response would fall between 12 and 25 milliamps.

When using more than one sensor such as disclosed in this invention, it is necessary to calibrate each sensor in the same manner. A sheet of a 20 lb. paper weight will be passed through each sensor 36, 74 with the current being adjusted at the emitter of each sensor to obtain a voltage response of 1.25 volts and then the sheet of a 60 lb. paper weight will be passed through each sensor 36, 74 with the current being adjusted at the emitter of each sensor 36, 74 to obtain a voltage response of 0.5 volt. If the alignment of the emitter and phototransistor of each sensor is the same and the response characteristics of each phototransistor are the same, then a current of 12 milliamps supplied to the emitter of each sensor should produce a voltage response of 1.25 volts and a current of 25 milliamps supplied to the emitter of each transducer should produce a voltage response of 0.5 volt. However, if the conditions at each sensor are not the same, then different current values may have to be supplied to each emitter to provide the given voltage response at a corresponding sensor for the same sheet.

Figure 4:
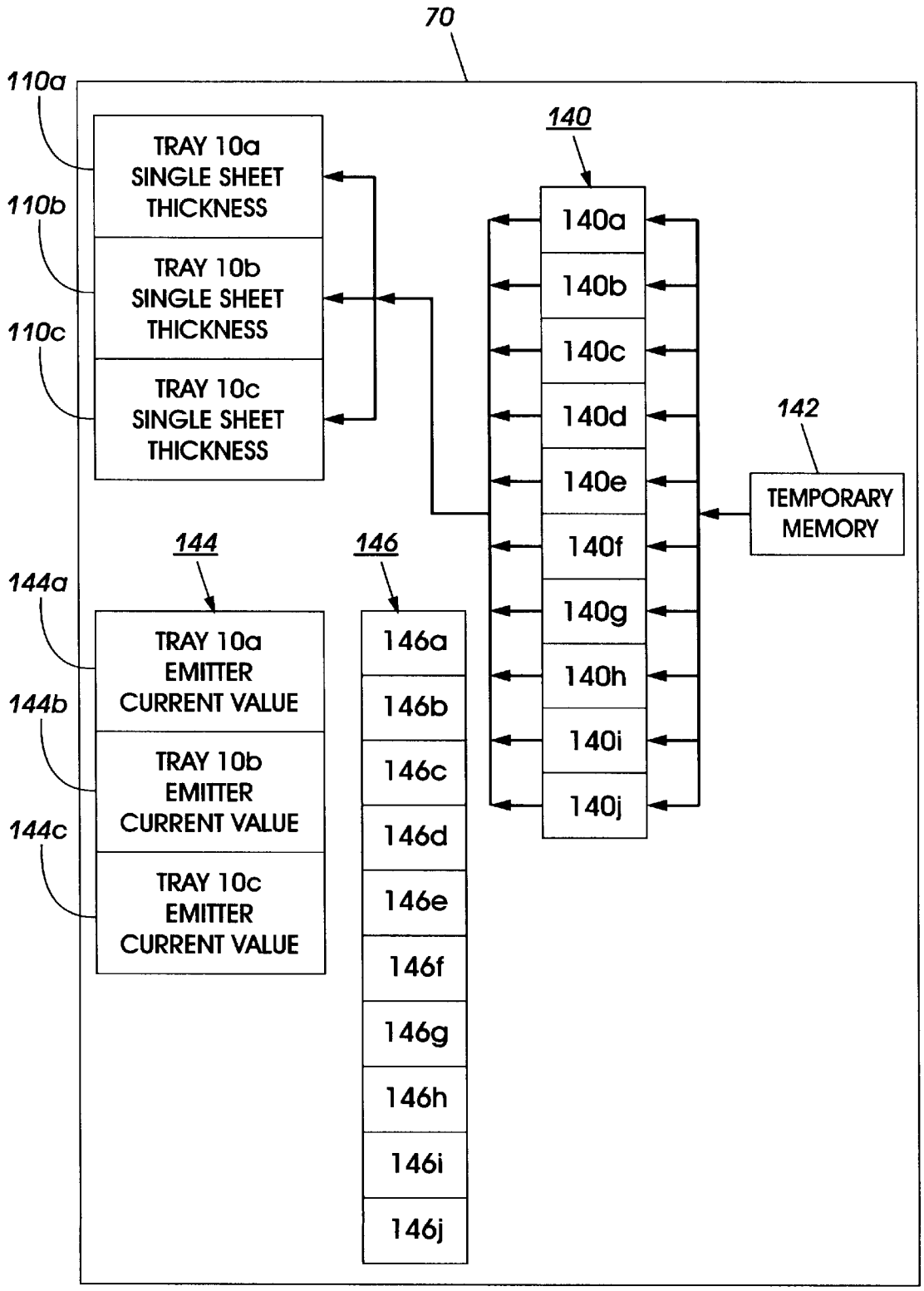
FIG. 4 is a block schematic diagram of a portion of a RAM memory of the schematic of FIG. 2.

The Ram section of the memory 70 is shown in FIG. 4. There are three memory locations 110*a*, 110*b* and 110*c* for storing the voltage response values (thickness value) at the phototransistor 40 for the sheets in each tray 10*a*, 10*b*, and 10*c*, respectively. The sensed thickness value of the first (or second sheet, which will be explained later) sheet fed from a particular tray is put into one of these locations for the particular tray from which a first (or second sheet, which will be explained later) sheet is fed. Temporary memory locations 140 are provided for storage of the thickness values sensed by the sensor 36 of all sheets fed from a tray. The number of locations 140 will be at least equal to the sheet capacity of the intermediate stacker 26. Ten locations, 140*a* through 140*j* are shown for illustrative purposes only. A temporary memory location 142 is provided for storage of the thickness values sensed by the outlet sensor 74. Each memory location contains a plurality of memory sites, depending upon the number of samplings taken during sensing of a sheet. Also provided are memory locations 144*a*, 144*b*, and 144*c* for storing the current value that is supplied to the emitter 38 for sensing sheets (other than the first sheet) fed from trays 10*a*, 10*b*, and 10*c*, respectively. Temporary memory locations 146 are provided for storage of the current values to be supplied to the emitter 76 when each sheet is sensed by sensor 74. The number of locations 146 will be at least equal to the sheet capacity of the intermediate stacker 26. Ten locations, 146*a* through 146*j* are shown for illustrative purposes only.

Using the above illustration and assuming that the paper weight ranges and the voltage response conditions are the same, but assume that a current value of 12 and 15 milliamps are supplied to the emitters, 38 and 76, respectively to obtain a voltage response at their corresponding sensors 36 and 74 of 1.25 volts when sensing a sheet of a 20 lb. paper weight and that a current value of 25 and 28 milliamps are supplied to the emitters 38 and 76, respectively to obtain a voltage response at their corresponding sensors 36 and 74 of 0.5 volt when sensing a sheet of a 60 lb. paper weight, the system can be set up as follows: the CPU 48 is programmed to communicate to the I/O buffer 69 the value of 12 milliamps for the initial current to be supplied to the emitter 38 for sensing a first sheet 12*a*, 12*b*, and 12*c* that is passed through the sensor 36 from each of the trays 10*a*, 10*b*, and 10*c*, respectively. The CPU is also programmed to supply a current of 12 milliamps to the emitter 38 for measuring the thickness of sheets that have a paper weight up to and including 50 lbs. and to supply a current of 25 milliamps to the emitter 38 for measuring the thickness of sheets that have a paper weight above 50 lbs. The CPU is further programmed to supply a current of 15 milliamps to the emitter 76 for measuring the thickness of sheets that have a paper weight up to and including 50 lbs. and to supply a current of 28 milliamps to the emitter 76 for measuring the thickness of sheets that have a paper weight above 50 lbs.

A voltage response value which corresponds to a voltage response at the phototransistor 40 for a sheet of a 50 lb. paper weight when 12 milliamps is supplied to the emitter 38 is stored in the EPROM. The EPROM contains a program which compares the voltage response value of the first sheet sensed from each tray 10*a*, 10*b*, and 10*c* with the stored voltage response value. If, for each respective tray, the voltage response of the first sheet is equal to or less than the stored value, the program will instruct the CPU 48 to input a value of 12 milliamps to the appropriate memory location 144*a*, 144*b*, and 144*c*. If, for each respective tray, the voltage response of the first sheet is above the stored value, the program will instruct the CPU 48 to input a value of 25 milliamps to the buffer 69 and to the appropriate memory location 144*a*, 144*b*, and 144*c* and instruct the feeder controller 79 to send a second sheet from the tray which had sheets heavier than 50 lbs. through the sensor 36 to obtain a voltage value when the emitter 38 is supplied with 25 milliamps.

The EPROM also contains a program for controlling measurement and storage of thickness values of the sheets 12*a*, 12*b*, and 12*c* arriving at the sensor 36 from the trays 10*a*, 10*b*, and 10*c* and for comparison of the thickness values for detecting double sheet feed from each of the trays 10*a*, 10*b* and 10*c*.

The CPU 48 is programmed to keep track of the sheets as they are fed from a particular tray until after they pass through the sensor 36 and place the sensed thickness values in the appropriate memory locations and compare the thickness values corresponding to the appropriate sheets and trays. The CPU 138 is also programmed to address the appropriate memory location 144*a*, 144*b*, 144*c* for the appropriate tray from which a sheet is being fed to obtain the appropriate current to be supplied to the emitter 38 and transmit the value of the current to the I/O buffer 69 prior to the time that each sheet is sensed by the sensor 36. Referring to FIG. 1, each tray 10*a*, 10*b*, and 10*c* has a sensor 150*a*, 150*b*, and 150*c* connected thereto for sensing when its respective tray has been lowered for refilling. The sensors 150*a*, 150*b*, and 150*c* are communicated to the CPU 48 by control lines 152*a*, 152*b*, and 152*c*, respectively. The sensor may be a contact switch, a push button switch or any other well known sensing device. When a tray is lowered, the sensor causes an interrupt through a respective control line at the CPU 48. The CPU 48 is programmed to respond to the interrupt to clear the appropriate memory location 110*a*, 110*b*, 110*c* for the tray that has been lowered and start the program for placing in the appropriate memory location for that tray the thickness value of the first sheet sensed that is fed from that tray after it is reloaded and to clear the I/O buffer 69 and input the value of the initial current of 12 milliamps to the I/O buffer 69 which is transmitted to the current source 114 to supply the emitter 38 with the initial current of 12 milliamps for measuring the thickness value of the first sheet sensed that is fed from the tray after it is reloaded.

In operation, the CPU 48 is programmed to transmit to the I/O buffer 69 the initial current value (12 milliamps) which is then transmitted to the current source 114 to supply 12 milliamps to the emitter 38. Referring to only sheets being fed from tray 10*a*, when a first sheet 12*a* is introduced into the sensor 36, there will be a sudden voltage change at the collector 50 which is sensed by the positive transition detector 50 which causes an interrupt through the control line 46 at CPU 48. The CPU 48 is programmed to only respond to the initial interrupt and ignore any subsequent interrupts until after the sheet of paper has left the sensor 36. In response to the initial interrupt, the CPU, in conjunction with the MMU 76, addresses the I/O buffer 52 which immediately resets the peak detector 44. The voltage at collector 43 can be sampled only once per sheet or a plurality of times as the sheet passes through the sensor. Sampling the sheet thickness once has a drawback if the sheet has an opaque portion or, if it is a preprinted form, has light and dark printing on it, since, if any of these are sensed, an incorrect reading of the thickness of a sheet will occur. Therefore it is desirable to sample the thickness of the sheet at more than one location. For example, the sheet can be sampled six times as the sheet passes through the sensor 36. Assuming that the sheet is 8½×11 inches and the 11 inch edge is the leading edge into the sensor 36, and the sheet passes across the sensor 36 at a speed of 65 inches per second, each sheet section sensed before sampling will be 1.4 inches and sampling will occur every 22 milliseconds.

The peak detector senses the voltage at collector 43 as the sheet passes between the emitter 38 and the phototransistor 40 with this voltage representing the thickness of the sheet. The voltage at the peak detector 44 is inputted to the A/D converter 60 in analogue form and this is converted to digital form by the A/D converter 60 and sent to the latch 56. The first sensing will be completed by a first sampling taken 22 milliseconds after entry of the sheet into the sensor 36. The latch will be set at 22 milliseconds to capture the peak voltage in peak detector 44 and the peak detector reset immediately thereafter for detecting the voltage over the next 1.4 inches of the sheet. Some time between the expiration of the first 22 milliseconds and the expiration of the next 22 milliseconds, the I/O buffer 52 will input the voltage information for the first sampling of the sheet to the memory 70. The same cycle is repeated until after the sixth 1.4 inch section is sampled. When a new sheet is introduced into the sensor 36, the sudden voltage change at the collector 43 is sensed by the positive transition detector 50 which causes an interrupt at the CPU 48 and the same cycle is repeated for the new sheet.

After the sixth 1.4 inch section of the sheet 12*a* is sampled while the sheet passes through sensor 36, the six sampled values of the first sheet 12*a* from the tray 10*a* are placed into memory location 110*a*. This thickness or voltage response value is compared to the voltage response value stored in the EPROM to determine if the paper weight of the sheet is at, below or above 50 lbs. to select the appropriate current to be supplied to the emitter 38 for sensing subsequent sheets. This can be achieved by comparing the sum of the six sensed values in memory location 110*a* with the sum of the six sensed values stored in the EPROM. If the sum of the voltage response of the sheet is equal to or less than the stored value, the paper weight of the sheet is at or below 50 lbs. If the sum of the voltage response of the sheet is above the stored value, the paper weight of the sheet is above 50 lbs.

If the appropriate current selected is 12 milliamps, the CPU 48 will input a value of 12 milliamps to memory location 144*a*, to be supplied to the emitter 38 for sensing subsequent sheets 12*a* from tray 10*a*, and the thickness value which was placed in memory location 110*a* will stay in that location as the thickness value for all of the remaining sheets in tray 10*a*. If the appropriate current selected is 25 milliamps, the CPU 48 is programmed to input a value of 25 milliamps to the buffer 69 and to memory location 144*a*, to be supplied to the emitter 38 for sensing subsequent sheets 12*a* from tray 10*a*, and to clear the thickness value placed in memory location 110*a* and instruct the feeder controller 79 to send a second sheet from tray 10*a* through the sensor 36 to obtain a voltage value when the emitter 38 is supplied with 25 milliamps, which value is then stored in memory location 110*a*.

The thickness value sensed for each sheet that is fed from tray 10*a* will be placed into one of the memory locations 140 in accordance with a queue position in which it is introduced into the sensor 36. For instance, if the first sheet 12*a* that is fed from the tray 10*a* is the second sheet to be introduced into the sensor 36, then the thickness value sensed will be placed in memory location 140*b*. Depending upon whether the sheet has a paper weight of up to and including 50 lbs. or above 50 lbs., a current value of 15 milliamps or 28 milliamps to be supplied to the emitter 76, when sensor 74 senses the same sheet, will be placed in memory location 146*b*. If a second sheet fed from tray 10*a* is the fourth sheet introduced into the sensor 36, then the thickness value sensed will be placed in memory location 140*d*. Depending upon whether the sheet has a paper weight of up to and including 50 lbs. or above 50 lbs., a current value of 15 milliamps or 28 milliamps to be supplied to the emitter 76, when sensor 74 senses the same sheet, will be placed in memory location 146*d*. If a third sheet fed from tray 10*a* is the seventh sheet introduced into the sensor 36, then the thickness value sensed will be placed in memory location 140*g*. Depending upon whether the sheet has a paper weight of up to and including 50 lbs. or above 50 lbs., a current value of 15 milliamps or 28 milliamps to be supplied to the emitter 76, when sensor 74 senses the same sheet, will be placed in memory location 146*g*

If the sensing of the thickness of the second sheet from tray 10*a* is not for the purpose of obtaining an initial voltage response value when 25 milliamps is supplied to the emitter 38, then that thickness value placed in memory location 140*d* and the thickness value of all subsequent sheets fed from tray 10*a* placed in a memory location 140 will be compared to the single sheet thickness value for tray 10*a* located in memory location 110*a*. If the sensing of the thickness of the second sheet from tray 10*a* is for the purpose of obtaining an initial voltage response value when 25 milliamps is supplied to the emitter 38, then the thickness value for that sheet is not compared with the single sheet thickness value for tray 10*a*, but the thickness value of the third sheet placed in memory location 140*g* and the thickness value of all subsequent sheets fed from tray 10*a* placed in memory location 140 will be compared with the single sheet thickness value for tray 10*a*. Since there will not be a thickness value in memory location 110*a* for the sheets in the tray 10*a* when the thickness value of the first sheet fed from the tray 10*a* and when the thickness value of the second sheet fed from the tray 10*a*, for the purpose of a thickness reading when 25 milliamps is supplied to the emitter 38, is sensed by sensor 36, these values will be placed in memory location 140*b* and 140*d*, but the single sheet thickness comparison function will not be run.

The thickness value in memory location 110*a* will stay in memory location 110*a* until the tray 10*a* is lowered to refill the tray at which time the sensor 150*a* will cause an interrupt through control line 152*a* at the CPU 48 and the CPU 48 will cause the value in memory location 110*a* to be cleared. The thickness value sensed by sensor 38 of either the first or second sheet fed (depending upon whether 12 milliamps or 25 milliamps is supplied to the emitter 38 for subsequent sheets) from the tray 10*a*, after the tray 10*a* has been refilled and after the memory location 110*a* has been cleared, will be placed into the memory location 110*a* as the new thickness value for all of the remaining new sheets 12*a* loaded onto tray 10*a*. The current value for emitter 38 in memory location 144*a* will stay in memory location 144*a* until the tray 110*a* is lowered to refill the tray at which time the CPU 48, in response to the interrupt through control line 152*a*, will clear the value from the memory location 144*a* and input the value of the initial amount of current (12 milliamps) to buffer 69. The proper current to be supplied to the emitter 38 for the new sheets 12*a* loaded onto tray 10*a* will be placed into memory location 144*a* after the first sheet from the reloaded tray is sensed by sensor 38.

For the purpose of the following example, it will be assumed that the thickness value for sheets for tray 10*a* was obtained from the first sheet fed from the tray and that value is in memory location 110*a*. When a subsequent sheet 12*a* is fed from the tray 10*a*, it is sensed by sensor 38 in the same manner as the first sheet was with six values being obtained and will be placed in appropriate one of the locations in memory location 140. Those values are compared with the six sampled values that are in memory location 110*a* for the first sheet. This can be achieved by comparing the sum of the six sensed values in memory location 140 with the sum of the six sensed values in memory location 110*a*. If the sums are within a chosen tolerance of each other, it will be assumed that only one sheet has passed through the sensor 38 and normal operation of the printing system will continue. If the sum of the six sensed values, of the first sheet fed, which is located in memory location 110*a*, is less than the sum of the six sensed values, located in memory location 140, of the subsequent sheet fed from tray 10*a*, by more than a chosen tolerance, then such will indicate a greater sheet thickness for the subsequent sheet than the first sheet. Thus, it will be assumed that more than one sheet has passed through the sensor 38 and a signal will be sent by the CPU 48 over the control line 77 to the feeder controller 79 to immediately stop the sheet feeding system. A system operator can then remove the double fed sheets and reset the system to resume normal operation. Alternatively, in response to the signal, the offending sheets can be sent to a purge tray at the printer without stopping the sheet feeding system.

When a first sheet 12*b* or 12*c* is fed from respective trays 10*b* or 10*c*, the sheet will be sensed by sensor 36 in the same manner as the sheet 12*a* is sensed by sensor 36 and it will be determined that either 12 milliamps or 25 milliamps will be supplied to the emitter 38 when subsequent sheets 12*b* and 12*c* pass through sensor 36. The CPU 48 inputs the appropriate current value into memory locations 144*b* and 144*c* to be supplied to the emitter 38 for sensing subsequent sheets 12*b* and 12*c* from trays 10*b* and 10*c*, respectively. The appropriate thickness value against which subsequent sheets will be compared will be determined by the measurement on the first sheet from the tray if 12 milliamps is to be supplied to the emitter 38 for sensing the subsequent sheets from that tray or by the measurement on the second sheet from a tray if 25 milliamps is to be supplied to the emitter 38 for sensing the subsequent sheets from that tray.

The thickness value sensed by sensor 36 for the first or second sheet, whichever is applicable, fed from each tray 10*b* and 10*c* will be placed in the memory location 110*b* for tray 10*b*, as the thickness value for all of the remaining sheets in tray 10*b*, or in memory location 110*c* for tray 10*c* as the thickness value for all of the remaining sheets in tray 10*c*. The thickness value in memory location 110*b* will stay in memory location 110*b* until the tray 10*b* is lowered to refill the tray at which time the sensor 150*b* will cause an interrupt through control line 152*b* at the CPU 48 and the current thickness value is cleared from memory location 110*b*. The thickness value sensed by sensor 36 of either the first or second sheet fed (depending upon whether 12 milliamps or 25 milliamps is supplied to the emitter 38 for subsequent sheets) from the tray 10*b*, after the tray 10*b* has been refilled and after the memory location 110*b* has been cleared, will be placed into the memory location 110*b* as the new thickness value for all of the remaining new sheets 12*b* loaded onto tray 10*b*. The thickness value in memory location 110*c* will stay in memory location 110*c* until the tray 10*c* is lowered to refill the tray at which time the sensor 150*c* will cause an interrupt through control line 152*c* at the CPU 48 and the current thickness value is cleared from memory location 110*c*. The thickness value sensed by sensor 36 of either the first or second sheet fed (depending upon whether 12 milliamps or 25 milliamps is supplied to the emitter 38 for subsequent sheets) from the tray 10*c*, after the tray 10*c* has been refilled and after the memory location 110*c* has been cleared, will be placed into the memory location 110*c* as the new thickness value for all of the remaining new sheets 12*c* loaded onto tray 10*c*.

The current value for emitter 38 in memory location 144*b* will stay in memory location 144*b* until the tray 10*b* is lowered to refill the tray at which time the CPU 48, in response to the interrupt through control line 150*b*, will clear the value from the memory location 144*b* and input the value of the initial amount of current (12 milliamps) to buffer 69. The current value for emitter 38 in memory location 144*c* will stay in memory location 144*c* until the tray 10*c* is lowered to refill the tray at which time the CPU 48, in response to the interrupt through control line 150*c*, will clear the value from the memory location 144*c* and input the value of the initial amount of current (12 milliamps) to buffer 69. The proper current to be supplied to the emitter 38 for the new sheets 12*b* loaded onto tray 10*b* will be placed into memory location 144*b* after the first sheet from the reloaded tray 10*b* is sensed by sensor 36. The proper current to be supplied to the emitter 38 for the new sheets 12*c* loaded onto tray 110*c* will be placed into memory location 144*c* after the first sheet from the reloaded tray 10*c* is sensed by sensor 36.

The thickness value sensed for each sheet that is fed from tray 10*b* and from tray 10*c* will be placed into one of the memory locations 140 in accordance with a queue position in which it is introduced into the sensor 36. Also, depending upon whether a particular sheet has a paper weight of up to and including 50 lbs. or above 50 lbs., a current value of 15 milliamps or 28 milliamps to be supplied to the emitter 76, when sensor 74 senses the same sheet, will be placed in an appropriate one of the memory locations 146. The comparison of the thickness values for subsequent sheets 12*b* and 12*c* in memory locations 140 with the single sheet thickness value for trays 10*b* and 10*c* which are in memory locations 110*b* and 110*c*, respectively, will be done in the same manner as the comparison for the thickness values of subsequent sheets 12*a* with the single sheet thickness value for tray 10*a*. Since there will not be a thickness value in memory locations 110*b* and 110*c* for the sheets in the trays 10*b* and 10*c*, respectively, when the thickness value of the first sheet fed from each respective tray and when the thickness value of the second sheet fed from each respective tray, for the purpose of a thickness reading when 25 milliamps is supplied to the emitter 38, is sensed by sensor 36, these values will be placed in memory locations 140, but the single sheet thickness comparison function will not be run.

The proper current value has to be supplied to the emitter 38 of the sensor 36 to sense subsequent sheets fed from a particular tray under the same conditions that the thickness value of the first or second sheet from that tray was sensed and which reside in memory locations 110*a*, 110*b*, and 110*c*. When each of the subsequent sheets are fed from a tray and are introduced into sensor 36, there will be a sudden voltage change at the collector 43 which is sensed by the positive transition detector 140 which causes an interrupt through the control line 46 at CPU 48. In response to the initial interrupt the CPU 48, in conjunction with the MMU 76, addresses the corresponding memory location 144*a*, 144*b*, 144*c* to obtain the pertinent current value to be supplied to the emitter 38 for sensing the sheet when it passes through sensor 36. The current value is sent to the I/O buffer 69 which causes the current source 114 to supply that current value to the emitter 38 for sensing the sheet just introduced into the sensor 36.

When a sheet 12 is fed from the intermediate sheet stacker 26 and introduced into the outlet sensor 74, there will be a sudden voltage change at the collector 80 which is sensed by the positive transition detector 88 which causes an interrupt through the control line 86 at CPU 48. The CPU 48 is programmed to only respond to the initial interrupt and ignore any subsequent interrupts until after the sheet of paper has left the sensor 74.

In response to the initial interrupt the CPU 48, in conjunction with the MMU 76, addresses the memory 146 to obtain the pertinent current value to be supplied to the emitter 76 for sensing the sheet when it passes through sensor 74. The current value is sent to the I/O buffer 71 which causes the current source 124 to supply that current value to the emitter 76. In response to the initial interrupt, the CPU 48 also, in conjunction with the MMU 76, addresses the I/O buffer 72 which immediately resets the peak detector 84. The voltage at collector 80 is sampled six times which is the same number that the voltage at collector 43 was sampled when the same sheet passed through sensor 36. The sheet passes through the outlet sensor 74 at approximately ½ the speed that the sheet passes through the inlet sensor 36. Therefore, each sheet section sensed before sampling will be 1.4 inches and sampling will occur ever 44 milliseconds.

The peak detector 84 senses the voltage at collector 80 as the sheet passes between the emitter 76 and the phototransistor 78 with this voltage representing the thickness of the sheet. The voltage at the peak detector 84 is inputted to the A/D converter 96 in analogue form and this is converted to digital form by the A/D converter 96 and sent to the latch 92. The first sensing will be completed by a first sampling taken 44 milliseconds after entry of the sheet into the sensor 74. The latch will be set at 44 milliseconds to capture the peak voltage in peak detector 84 and the peak detector reset immediately thereafter for detecting the voltage over the next 1.4 inches of the sheet. Some time between the expiration of the first 44 milliseconds and the expiration of the next 44 milliseconds, the I/O buffer 72 will input the voltage information for the first sampling of the sheet to temporary memory location 142. The same cycle is repeated until after the sixth 1.4 inch section is sampled. After the sixth 1.4 inch section of a sheet is sampled while the sheet passes through outlet sensor 74, the sum of the six sampled values of the same sheet as it passed through the sensor 36 and which are stored in memory 140 are compared with the sum of the six sampled values of the sheet as it passed through the outlet sensor 74.

The thickness values in each of the memory locations 140*a*–140*j* and the current values in each of the memory locations 146*a*–146*j* will stay in such memory location until the sheet associated with such memory locations passes through outlet sensor 74 and the thickness value comparison is made at which time the CPU 48 clears the memory locations associated with that sheet, including memory location 142.

In order to know which sheet is entering the intermediate outlet sensor 74, a first in, first out system is set up. If a plurality of sheets are introduced into the intermediate stacker after passing through the sensor 36, the first sheet into the stacker will be the first sheet out of the stacker since the vacuum transport belt 28 is at the bottom of the stacker and feeds sheets to the outlet sensor 74 from the bottom of the stack of sheets in the intermediate stacker 26.

In summary and as an example, assume that a sheet 12 was passed through sensor 36 from a tray 10*a* that had sheets thereon which had a paper weight above 50 lbs. Also assume that this sheet was the seventh one to pass through sensor 36. The thickness value of this sheet sensed by sensor 36 will have been stored in memory location 140*g* and a current value of 28 milliamps to be supplied to the emitter 76 when this sheet is sensed by sensor 74 will have been stored in memory location 146*g*. When the sheet 12 exits the intermediate stacker 26 and enters the outlet sensor 74, there is a sudden voltage change at the collector 80 which is sensed by the positive transition detector 88. There is an initial interrupt caused by positive transition detector 88 and in response thereto, the CPU 48 will address memory location 146*g* to obtain the 28 milliamp value and input that value to the I/O buffer 71 which causes the current source 124 to supply 28 milliamps to the emitter 76 of outlet sensor 74. The thickness value sensed by sensor 74 of sheet 12 is stored in temporary memory 142 and will be compared to the thickness value stored in memory location 140*g* in the same manner that the same sheet thickness value in memory 140*g* was compared to the appropriate tray single sheet thickness in memory 110. After the comparison is made, the CPU 48 causes the memory locations 140*g* and 146*g* and temporary memory location 142 to be cleared. If it is determined that only one sheet has passed through the outlet sensor 74, normal operation of the printing system will continue. If it is determined that more than one sheet has passed through the outlet sensor 74, a signal will be sent by the CPU 48 over the control line 77 to the feeder controller 79 to immediately stop the sheet feeding system. A system operator can then remove the double fed sheets and reset the system to resume normal operation. Alternatively, in response to the signal, the offending sheets can be sent to a purge tray at the printer without stopping the sheet feeding system.

When a new sheet is introduced into the sensor 74, the sudden voltage change at the collector 80 is sensed by the positive transition detector 88 which causes an interrupt at CPU 48 and the same cycle is repeated for the new sheet.

It should be understood that the selection of 12 milliamps and 25 milliamps as the operating currents for the emitters and for generating the curves in FIG. 3 is for illustrative purposes only. Other magnitudes of current can be selected depending upon the desirable voltage response specifications of the system, the response characteristics between the emitter and phototransistor and other factors.

Figure 5:
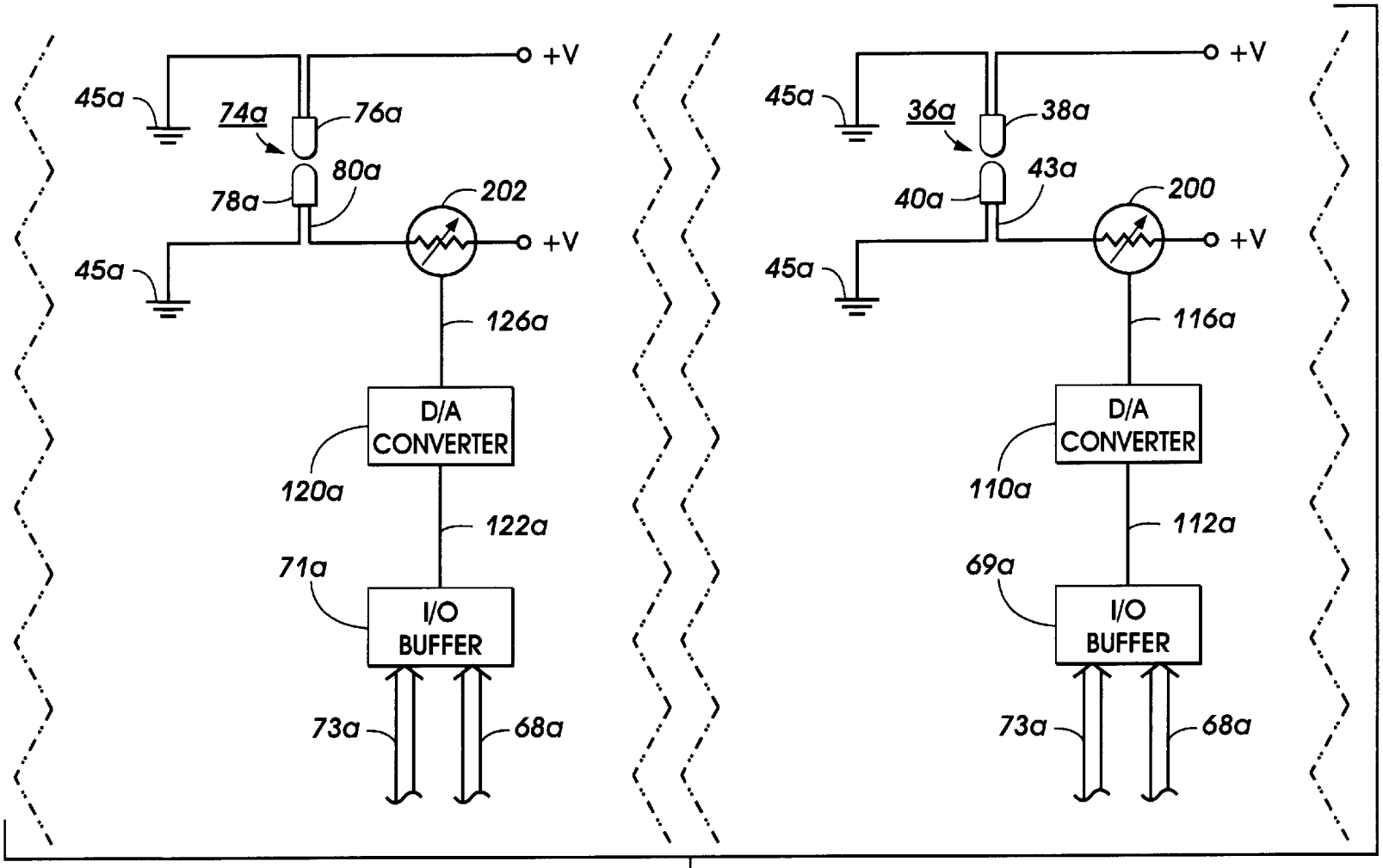
FIG. 5 is a modified block schematic diagram of the embodiment of FIGS. 1–4.

Rather than control the amount of current supplied to the emitter of a sensor to provide the desired voltage response at the sensor, resistance in a phototransistor collector circuit can be varied to provide the desired voltage response condition. A simplified schematic illustrating this principle is shown in FIG. 5. All elements that are the same as shown in the embodiment illustrated in FIG. 2 are represented by the same reference numerals, only with an "a" affixed thereto. The fixed resistors 41 and 81 of the schematic shown in embodiment of FIG. 2 are replaced by variable resistors 200 and 202, respectively. The resistance of resistors 200 and 202 can be varied by any well known circuit means. As stated previously, the voltage response at the collector of each sensor increases with an increase in paper weight since less current flows from each phototransistor 40*a* and 78*a* through their corresponding resistors 200 and 202. Since more current flows through the resistors 200 and 202 when lighter sheets are sensed by their sensors than when heavier sheets are sensed, the resistance must be decreased to increase the voltage response at the collector. Since less current flows through the resistors 200 and 202 when heavier sheets are sensed by their sensors than when lighter sheets are sensed, the resistance must be increased to decrease the voltage response at the collector.

Accordingly, in order to have a voltage response at a sensor which is higher, when the sensor is in the first condition and sensing a sheet of a given paper weight than it will have when in a second condition and sensing a sheet of the same paper weight, the resistance value of the resistor has to be higher when the sensor is in the first condition than the resistance value of the resistor when the sensor is in the second condition.

When calibrating the sensors to sense sheets in each range of paper weight values, a voltage response can be selected for a sheet of a paper weight of 20 lbs. and such sheet is passed through each sensor 36*a* and 74*a*. The resistance of resistors 200 and 202 will be adjusted to provide the desired voltage response at each sensor 36*a* 74*a*. Then a voltage response can be selected for a sheet of a paper weight of 60 lbs. and such sheet is passed through each sensor. The resistance of resistors 200 and 202 will be adjusted to provide the desired voltage response at each sensor. If the alignment of the emitter and phototransistor of each sensor is the same and the response characteristics of each phototransistor are the same, then the same resistance value at the resistor of each sensor should provide the same desired voltage response when sensing the same sheet. However, if the conditions at each sensor are not the same, then there may have to be different resistance values at the resistor of each sensor to provide the same desired voltage response when sensing the same sheet. The calibrations can be performed manually.

The operation of the system described will be the same, only instead of current values being changed at the sensors 36 and 74, resistance values will be changed at the sensors 36*a* and 74*a*. For instance, the CPU 48 will be programmed to provide a first resistance value at the resistor 200 for measuring the thickness of sheets that have a paper weight up to and including 50 lbs. and to supply a second resistance value, which is higher than the first resistance value, at the resistor 200 for measuring the thickness of sheets that have a paper weight above 50 lbs. The CPU is further programmed to provide a third resistance value at the resistor 202 for measuring the thickness of sheets that have a paper weight up to and including 50 lbs. and to supply a fourth resistance value, which is higher than the third resistance value, at the resistor 202 for measuring the thickness of sheets that have a paper weight above 50 lbs. Depending upon the conditions at each sensor, the first and third resistances may or may not be substantially equal and the third and fourth resistances may or may not be substantially equal. The I/O buffers 69*a* and 71*a* will be controlled to transmit resistance values to the variable resistors 200 and 202, respectively, instead of I/O buffers 69 and 71 transmitting current values in the previous embodiment. Memory locations 146 will be used to store the appropriate resistance values to be used for each sheet instead of storing the current values of the previous embodiment.

In following the main principle of this invention, more than two ranges of paper weights can be selected. A different voltage response condition for the sensor can be set for each of the paper weight ranges as long as the sensor, when in a voltage response condition for sensing sheets from a range that encompasses sheets that are heavier than the sheets in another range, will have a voltage response which is lower than when the same sensor senses a sheet of the same paper weight, when the sensor is in a given voltage response condition for sensing sheets in another range.

Instead of comparing sums of values, each value sampled at the inlet sensor 36 can be compared with each corresponding value sampled for the first sheet fed from an appropriate tray and can be compared with each corresponding value sampled at the outlet sensor 74. If a certain number of values match within a given tolerance, it will be assumed that only one sheet passed through the sensors. For instance, if four of the six sensed values match, it will be assumed that only one sheet passed through the sensor. In this case, the sum of the samplings at the sensor 36 for the first sheet sensed from each tray could still be used for comparison with the thickness value stored in the EPROM to determine the current value to be used at the emitter 38 for sensing subsequent sheets fed from that tray. Obviously, other ways of comparing values can be used and the number of samplings can be changed to a particular situation desired. The comparison function can be conducted as a new sheet is fed from any tray into its respective sensor. This way, the system is not held up while a comparison is being made.

The system described is based upon assuming that the first and second sheets (the thickness value of which is relied upon as representative of the thickness value for the remaining sheets from a corresponding tray) from a tray 10*a*, 10*b* and 10*c* are truly single sheets and are not double sheets. This system could be modified to detect double sheets being fed as such a first or second single sheet from a tray. For instance, if such first or second sheet fed from a tray is a double fed sheet, a subsequent sheet fed from that tray will be sensed to have a lower voltage response beyond a given tolerance than the first or second sheet indicating the first or second sheet was a double fed sheet. The system will be stopped, the double fed sheets removed and the first or second fed sheet sensing reinitiated.

The system and the electronic components thereof have been described in general. It should be realized that well known programming techniques and off-the-shelf hardware are all that is required to achieve the principles of this invention. Thus someone with ordinary skill in the art will be able to construct the system described.

We claim:

1. In a sheet transport system comprising:

a. a first tray for supporting a stack of sheets, b. a first sensor located to sense a thickness or paper weight value of each sheet discharged from said first tray, c. a second tray for receiving sheets discharged from said first tray, d. a second sensor for sensing a thickness or paper weight value of each sheet discharged from said second tray, e. each said first sensor and said second sensor comprising an emitter and a phototransistor being so constructed and arranged to receive sheets therebetween, f. each said emitter emitting light rays towards its respective said phototransistor, g. each said sensor having a voltage response in accordance with the amount of light sensed by said phototransistor, h. condition changing means operably connected to said first sensor and condition changing means operably connected to said second sensor for changing the conditions of voltage response of a corresponding one of said sensors, i. said conditions of voltage response being at least one condition for sensing sheets of a first given range of sheet thickness or paper weight value and a second condition for sensing sheets of a second given range of sheets that are thicker or heavier value than said first given range, j. said first sensor and said second sensor each having a voltage response when in said one condition that is higher for a sheet of a given thickness or paper weight value than the voltage response for a sheet of the same given thickness or paper weight value when each of said first sensor and said second sensor is in said second condition, k. said condition changing means for said first sensor being responsive to the thickness or paper weight value sensed by said first sensor of a sheet from said first tray to set the condition of voltage response for said first sensor, when sensing remaining sheets from said first tray, in accordance with a corresponding one of said given ranges of thickness or paper weight values, l. means for comparing the thickness or paper weight value sensed by said first sensor of each of the remaining sheets from said first tray with the thickness or paper weight value sensed by said first sensor of a given sheet from said first tray, when said first sensor was in the same voltage response condition corresponding to the given range of thickness or paper weight value for sensing the remaining sheets of said first tray, and generating a signal indicating a misfeed if the values differ by a predetermined amount, m. said condition changing means for said second sensor setting the condition of voltage response for said second sensor, when sensing the thickness or paper weight value of a sheet being discharged from said second tray, to be the same condition as set for said first sensor when the same sheet was sensed by said first sensor, and n. means for comparing the thickness or paper weight value sensed at the first sensor with the thickness or paper weight value sensed at the second sensor of the same sheet and generating a signal indicating a misfeed if the values differ by a predetermined amount.

2. In the sheet transport system of claim 1 further comprising:

a. means for storing in memory a thickness or paper weight value sensed by said first sensor of the given sheet from said first tray, and b. said means for comparing the thickness or paper weight values of sheets from said first tray sensed by said first sensor comprising means for comparing the thickness or paper weight value in memory of the given sheet from said first tray with the thickness or paper weight value sensed by said first sensor of each of the remaining sheets from said first tray.

3. In the sheet transport system of claim 2 further comprising:

a. means for storing in memory a thickness or paper weight value sensed by said first sensor of each the remaining sheets from said first tray, and b. said means for comparing the thickness or paper weight value sensed at the first sensor with the thickness or paper weight value sensed at the second sensor of the same sheet comprising means for comparing the thickness or paper weight value in memory of the sheet sensed by said first sensor with the thickness or paper weight value sensed by said second sensor.

4. In a sheet transport system of claim 3 wherein:

a. said condition changing means for each of said first sensor and said second sensor comprises means for changing a current supplied to each of said emitters with a first given current being supplied to said emitter of said first sensor when said first sensor is in said one condition and a second given current, which is greater than the first given current, being supplied to said emitter said first sensor when said first sensor is in said second condition and with a third given current being supplied to said emitter of said second sensor when said second sensor is in said one condition and a fourth given current, which is greater than the third given current, being supplied to said emitter of said second sensor when said second sensor is in said second condition, and b. the voltage response at each said sensor for sensing a given sheet is substantially the same when the first given current is supplied to said emitter of said first sensor and the third given current is supplied to said emitter of said second sensor and the voltage response at each said sensor for sensing a given sheet is substantially the same when the second given current is supplied to said emitter of said first sensor and the fourth given current is supplied to said emitter of said second sensor.

5. In a sheet transport system of claim 3 further comprising:

a. each said phototransistor having a collector, b. a voltage source, c. electrical resistance means for said first sensor operably connected to said voltage source and said collector of said first sensor and electrical resistance means for said second sensor operably connected to said voltage source and said collector of said second sensor, and d. said condition changing means for said first sensor comprising means for changing the resistance value of said electrical resistance means for said first sensor with a first given resistance value being supplied by said electrical resistance means for said first sensor when said first sensor is in said one condition and a second given resistance value, which is greater than the first given resistance value, being supplied by said electrical resistance means for said first sensor when said first sensor is in said second condition, e. said condition changing means for said second sensor comprising means for changing the resistance value of said electrical resistance means for said second sensor with a third given resistance value being supplied by said electrical resistance means for said second sensor when said second sensor is in said one condition and a fourth given resistance value, which is greater than the third given resistance value, being supplied by said electrical resistance means for said second sensor when said second sensor is in said second condition, and f. the voltage response at each said sensor for sensing a given sheet is substantially the same when the first given resistance value is supplied to said first sensor and the third given resistance value is supplied to said second sensor and the voltage response at each said sensor for sensing a given sheet is substantially the same when the second given resistance value is supplied to said first sensor and the fourth given resistance value is supplied to said second sensor.

6. In a sheet transport system of claim 3 further comprising:

a. tracking means for keeping track of a sheet from at least when it is discharged from said first tray until the thickness or paper weight value sensed at said first sensor and the thickness or paper weight value sensed at said second sensor are compared, b. said tracking means further being so constructed and arranged to instruct said condition changing means for said second sensor to set the condition of voltage response for said second sensor when sensing the thickness or paper weight value of a sheet being discharged from said second tray to be the same condition as set for said first sensor when the same sheet was sensed by said first sensor.

7. In a sheet transport system of claim 1 wherein:

a. said condition changing means for each of said first sensor and said second sensor comprises means for changing a current supplied to each of said emitters with a first given current being supplied to said emitter of said first sensor when said first sensor is in said one condition and a second given current, which is greater than the first given current, being supplied to said emitter of said first sensor when said first sensor is in said second condition and with a third given current being supplied to said emitter of said second sensor when said second sensor is in said one condition and a fourth given current, which is greater than the third given current, being supplied to said emitter of said second sensor when said second sensor is in said second condition, and b. the voltage response at each said sensor for sensing a given sheet is substantially the same when the first given current is supplied to said emitter of said first sensor and the third given current is supplied to said emitter of said second sensor and the voltage response at each said sensor for sensing a given sheet is substantially the same when the second given current is supplied to said emitter of said first sensor and the fourth given current is supplied to said emitter of said second sensor.

8. In a sheet transport system of claim 7 wherein the first and third given current values are different and the second and fourth given current values are different.

9. In a sheet transport system of claim 7 wherein the first and third given current values are substantially equal and the second and fourth given current values are substantially equal.

10. In a sheet transport system of claim 1 further comprising:

a. each said phototransistor having a collector, b. a voltage source, c. electrical resistance means for said first sensor operably connected to said voltage source and said collector of said first sensor and electrical resistance means for said second sensor operably connected to said voltage source and said collector of said second sensor, and d. said condition changing means for said first sensor comprising means for changing the resistance value of said electrical resistance means for said first sensor with a first given resistance value being supplied by said electrical resistance means for said first sensor when said first sensor is in said one condition and a second given resistance value, which is greater than the first given resistance value, being supplied by said electrical resistance means for said first sensor when said first sensor is in said second condition, e. said condition changing means for said second sensor comprising means for changing the resistance value of said electrical resistance means for said second sensor with a third given resistance value being supplied by said electrical resistance means for said second sensor when said second sensor is in said one condition and a fourth given resistance value, which is greater than the third given resistance value, being supplied by said electrical resistance means for said second sensor when said second sensor is in said second condition, and f. the voltage response at each said sensor for sensing a given sheet is substantially the same when the first given resistance value is supplied to said first sensor and the third given resistance value is supplied to said second sensor and the voltage response at each said sensor for sensing a given sheet is substantially the same when the second given resistance value is supplied to said first sensor and the fourth given resistance value is supplied to said second sensor.

11. In a sheet transport system of claim 10 wherein the first and third given resistance values are different and the second and fourth given resistance values are different.

12. In a sheet transport system of claim 10 wherein the first and third given resistance values are substantially equal and the second and fourth given resistance values are substantially equal.

13. In a sheet transport system of claim 1 further comprising:

a. tracking means for keeping track of a sheet from at least when it is discharged from said first tray until the thickness or paper weight value sensed at said first sensor and the thickness or paper weight value sensed at said second sensor are compared, b. said tracking means further being so constructed and arranged to instruct said condition changing means for said second sensor to set the condition of voltage response for said second sensor when sensing the thickness or paper weight value of a sheet being discharged from said second tray to be the same condition as set for said first sensor when the same sheet was sensed by said first sensor.

14. In a sheet transport system of claim 13 wherein:

a. said condition changing means for each of said first sensor and said second sensor comprises means for changing a current supplied to each of said emitters with a first given current being supplied to said emitter of said first sensor when said first sensor is in said one condition and a second given current, which is greater than the first given current, being supplied to said emitter of said first sensor when said first sensor is in said second condition and with a third given current being supplied to said emitter of said second sensor when said second sensor is in said one condition and a fourth given current, which is greater than the third given current, being supplied to said emitter of said second sensor when said second sensor is in said second condition, and b. the voltage response at each said sensor for sensing a given sheet is substantially the same when the first given current is supplied to said emitter of said first sensor and the third given current is supplied to said emitter of said second sensor and the voltage response at each said sensor for sensing a given sheet is substantially the same when the second given current is supplied to said emitter of said first sensor and the fourth given current is supplied to said emitter of said second sensor.

15. In a sheet transport system of claim 13 further comprising:

a. each said phototransistor having a collector, b. a voltage source, c. electrical resistance means for said first sensor operably connected to said voltage source and said collector of said first sensor and electrical resistance means for said second sensor operably connected to said voltage source and said collector of said second sensor, and d. said condition changing means for said first sensor comprising means for changing the resistance value of said electrical resistance means for said first sensor with a first given resistance value being supplied by said electrical resistance means for said first sensor when said first sensor is in said one condition and a second given resistance value, which is greater than the first given resistance value, being supplied by said electrical resistance means for said first sensor when said first sensor is in said second condition, e. said condition changing means for said second sensor comprising means for changing the resistance value of said electrical resistance means for said second sensor with a third given resistance value being supplied by said electrical resistance means for said second sensor when said second sensor is in said one condition and a fourth given resistance value, which is greater than the third given resistance value, being supplied by said electrical resistance means for said second sensor when said second sensor is in said second condition, and f. the voltage response at each said sensor for sensing a given sheet is substantially the same when the first given resistance value is supplied to said first sensor and the third given resistance value is supplied to said second sensor and the voltage response at each said sensor for sensing a given sheet is substantially the same when the second given resistance value is supplied to said first sensor and the fourth given resistance value is supplied to said second sensor.

16. In a sheet transport system comprising:

a. a first tray for supporting a stack of sheets, b. a second tray for supporting a stack of sheets, c. a first sensor located to sense a thickness or paper weight value of each sheet discharged from each of said first and second trays, d. a third tray for receiving sheets discharged from said first and second trays, e. a second sensor for sensing a thickness or paper weight value of each sheet discharged from said third tray, f. each said first sensor and said second sensor comprising an emitter and a phototransistor being so constructed and arranged to receive sheets therebetween, g. each said emitter emitting light rays towards its respective said phototransistor, h. each said sensor having a voltage response in accordance with the amount of light sensed by said phototransistor, i. condition changing means operably connected to said first sensor and condition changing means operably connected to said second sensor for changing the conditions of voltage response of a corresponding one of said sensors, j. said conditions of voltage response being at least one condition for sensing sheets of a first given range of sheet thickness or paper weight value and a second condition for sensing sheets of a second given range of sheets that are thicker or heavier value than said first given range, k. said first sensor and said second sensor each having a voltage response when in said one condition that is higher for a sheet of a given thickness or paper weight value than the voltage response for a sheet of the same given thickness or paper weight value when each of said first sensor and said second sensor is in said second condition, l. said condition changing means for said first sensor being responsive to the thickness or paper weight value sensed by said first sensor of a sheet from said first tray to set the condition of voltage response for said first sensor, when sensing remaining sheets from said first tray, in accordance with a corresponding one of said given ranges of thickness or paper weight values and being responsive to the thickness or paper weight value sensed by said first sensor of a sheet from said second tray to set the condition of voltage response for said sensor, when sensing remaining sheets from said second tray, in accordance with a corresponding one of said given ranges of thickness or paper weight values, m. means for comparing the thickness or paper weight value sensed by said first sensor of each of the remaining sheets from said first tray with the thickness or paper weight value sensed by said first sensor of a given sheet from said first tray, when said first sensor was in the same voltage response condition corresponding to the given range of thickness or paper weight value for sensing the remaining sheets of said first tray, and generating a signal indicating a misfeed if the values differ by a predetermined amount, n. means for comparing the thickness or paper weight value sensed by said first sensor of each of the remaining sheets from said second tray with the thickness or paper weight value sensed by said first sensor of a given sheet from said second tray, when said first sensor was in the same voltage response condition corresponding to the given range of thickness or paper weight value for sensing the remaining sheets of said second tray, and generating a signal indicating a misfeed if the values differ by a predetermined amount, o. said condition changing means for said second sensor setting the condition of voltage response for said second sensor, when sensing the thickness or paper weight value of a sheet being discharged from said third tray, to be the same condition as set for said first sensor when the same sheet was sensed by said first sensor, and p. means for comparing the thickness or paper weight value sensed at the first sensor with the thickness or paper weight value sensed at the second sensor of the same sheet and generating a signal indicating a misfeed if the values differ by a predetermined amount.

17. In the sheet transport system of claim 16 further comprising:

a. means for storing in memory a thickness or paper weight value sensed by said first sensor of the given sheet from said first tray, b. said means for comparing the thickness or paper weight values of sheets from said first tray sensed by said first sensor comprising means for comparing the thickness or paper weight value in memory of the given sheet from said first tray with the thickness or paper weight value sensed by said first sensor of each of the remaining sheets from said first tray, c. means for storing in memory a thickness or paper weight value sensed by said first sensor of the given sheet from said second tray, and d. said means for comparing the thickness or paper weight values of sheets from said second tray sensed by said first sensor comprising means for comparing the thickness or paper weight value in memory of the given sheet from said second tray with the thickness or paper weight value sensed by said first sensor of each of the remaining sheets from said second tray.

18. In the sheet transport system of claim 17 further comprising:

a. means for storing in memory a thickness or paper weight value sensed by said first sensor of each the remaining sheets from each of said first and said second trays, and b. said means for comparing the thickness or paper weight value sensed at the first sensor with the thickness or paper weight value sensed at the second sensor of the same sheet comprising means for comparing the thickness or paper weight value in memory of the sheet sensed by said first sensor with the thickness or paper weight value sensed by said second sensor.

19. In a sheet transport system of claim 18 wherein:

a. said condition changing means for each of said first sensor and said second sensor comprises means for changing a current supplied to each of said emitters with a first given current being supplied to said emitter of said first sensor when said first sensor is in said one condition and a second given current, which is greater than the first given current, being supplied to said emitter of said first sensor when said first sensor is in said second condition and with a third given current being supplied to said emitter of said second sensor when said second sensor is in said one condition and a fourth given current, which is greater than the third given current, being supplied to said emitter of said second sensor when said second sensor is in said second condition, and b. the voltage response at each said sensor for sensing a given sheet is substantially the same when the first given current is supplied to said emitter of said first sensor and the third given current is supplied to said emitter of said second sensor and the voltage response at each said sensor for sensing a given sheet is substantially the same when the second given current is supplied to said emitter of said first sensor and the fourth given current is supplied to said emitter of said second sensor.

20. In a sheet transport system of claim 18 further comprising:

a. each said phototransistor having a collector, b. a voltage source, c. electrical resistance means for said first sensor operably connected to said voltage source and said collector of said first sensor and electrical resistance means for said second sensor operably connected to said voltage source and said collector of said second sensor, and d. said condition changing means for said first sensor comprising means for changing the resistance value of said electrical resistance means for said first sensor with a first given resistance value being supplied by said electrical resistance means for said first sensor when said first sensor is in said one condition and a second given resistance value, which is greater than the first given resistance value, being supplied by said electrical resistance means for said first sensor when said first sensor is in said second condition, e. said condition changing means for said second sensor comprising means for changing the resistance value of said electrical resistance means for said second sensor with a third given resistance value being supplied by said electrical resistance means for said second sensor when said second sensor is in said one condition and a fourth given resistance value, which is greater than the third given resistance value, being supplied by said electrical resistance means for said second sensor when said second sensor is in said second condition, and f. the voltage response at each said sensor for sensing a given sheet is substantially the same when the first given resistance value is supplied to said first sensor and the third given resistance value is supplied to said second sensor and the voltage response at each said sensor for sensing a given sheet is substantially the same when the second given resistance value is supplied to said first sensor and the fourth given resistance value is supplied to said second sensor.

21. In a sheet transport system of claim 16 wherein:

a. said condition changing means for each of said first sensor and said second sensor comprises means for changing a current supplied to each of said emitters with a first given current being supplied to said emitter of said first sensor when said first sensor is in said one condition and a second given current, which is greater than the first given current, being supplied to said emitter of said first sensor when said first sensor is in said second condition and with a third given current being supplied to said emitter of said second sensor when said second sensor is in said one condition and a fourth given current, which is greater than the third given current, being supplied to said emitter of said second sensor when said second sensor is in said second condition, and b. the voltage response at each said sensor for sensing a given sheet is substantially the same when the first given current is supplied to said emitter of said first sensor and the third given current is supplied to said emitter of said second sensor and the voltage response at each said sensor for sensing a given sheet is substantially the same when the second given current is supplied to said emitter of said first sensor and the fourth given current is supplied to said emitter of said second sensor.

22. In a sheet transport system of claim 16 further comprising:

a. each said phototransistor having a collector, b. a voltage source, c. electrical resistance means for said first sensor operably connected to said voltage source and said collector of said first sensor and electrical resistance means for said second sensor operably connected to said voltage source and said collector of said second sensor, and d. said condition changing means for said first sensor comprising means for changing the resistance value of said electrical resistance means for said first sensor with a first given resistance value being supplied by said electrical resistance means for said first sensor when said first sensor is in said one condition and a second given resistance value, which is greater than the first given resistance value, being supplied by said electrical resistance means for said first sensor when said first sensor is in said second condition, e. said condition changing means for said second sensor comprising means for changing the resistance value of said electrical resistance means for said second sensor with a third given resistance value being supplied by said electrical resistance means for said second sensor when said second sensor is in said one condition and a fourth given resistance value, which is greater than the third given resistance value, being supplied by said electrical resistance means for said second sensor when said second sensor is in said second condition, and f. the voltage response at each said sensor for sensing a given sheet is substantially the same when the first given resistance value is supplied to said first sensor and the third given resistance value is supplied to said second sensor and the voltage response at each said sensor for sensing a given sheet is substantially the same when the second given resistance value is supplied to said first sensor and the fourth given resistance value is supplied to said second sensor.

23. In a sheet transport system of claim 16 further comprising:

a. tracking means for keeping track of a sheet from at least when it is discharged from said first or second tray until the thickness or paper weight value sensed at said first sensor and the thickness or paper weight value sensed at said second sensor are compared, b. said tracking means further being so constructed and arranged to instruct said condition changing means for said second sensor to set the condition of voltage response for said second sensor when sensing the thickness or paper weight value of a sheet being discharged from said second tray to be the same condition as set for said first sensor when the same sheet was sensed by said first sensor.

24. In a sheet transport system of claim 23 wherein:

a. said condition changing means for each of said first sensor and said second sensor comprises means for changing a current supplied to each of said emitters with a first given current being supplied to said emitter of said first sensor when said first sensor is in said one condition and a second given current, which is greater than the first given current, being supplied to said emitter of said first sensor when said first sensor is in said second condition and with a third given current being supplied to said emitter of said second sensor when said second sensor is in said one condition and a fourth given current, which is greater than the third given current, being supplied to said emitter of said second sensor when said second sensor is in said second condition, and b. the voltage response at each said sensor for sensing a given sheet is substantially the same when the first given current is supplied to said emitter of said first sensor and the third given current is supplied to said emitter of said second sensor and the voltage response at each said sensor for sensing a given sheet is substantially the same when the second given current is supplied to said emitter of said first sensor and the fourth given current is supplied to said emitter of said second sensor.

25. In a sheet transport system of claim 23 further comprising:

a. each said phototransistor having a collector, b. a voltage source, c. electrical resistance means for said first sensor operably connected to said voltage source and said collector of said first sensor and electrical resistance means for said second sensor operably connected to said voltage source and said collector of said second sensor, and d. said condition changing means for said first sensor comprising means for changing the resistance value of said electrical resistance means for said first sensor with a first given resistance value being supplied by said electrical resistance means for said first sensor when said first sensor is in said one condition and a second given resistance value, which is greater than the first given resistance value, being supplied by said electrical resistance means for said first sensor when said first sensor is in said second condition, e. said condition changing means for said second sensor comprising means for changing the resistance value of said electrical resistance means for said second sensor with a third given resistance value being supplied by said electrical resistance means for said second sensor when said second sensor is in said one condition and a fourth given resistance value, which is greater than the third given resistance value, being supplied by said electrical resistance means for said second sensor when said second sensor is in said second condition, and f. the voltage response at each said sensor for sensing a given sheet is substantially the same when the first given resistance value is supplied to said first sensor and the third given resistance value is supplied to said second sensor and the voltage response at each said sensor for sensing a given sheet is substantially the same when the second given resistance value is supplied to said first sensor and the fourth given resistance value is supplied to said second sensor.

* * * * *